US011059053B2

(12) United States Patent
Eliasson et al.

(10) Patent No.: US 11,059,053 B2
(45) Date of Patent: Jul. 13, 2021

(54) CENTRIFUGAL SEPARATOR STRUCTURE AND ASSEMBLY HAVING AN UNJOURNALED AXLE MEMBER

(71) Applicant: ALFDEX AB, Landskrona (SE)

(72) Inventors: Thomas Eliasson, Älvsjö (SE); Peter Franzén, Bandhagen (SE); Torgny Lagerstedt, Stockholm (SE)

(73) Assignee: ALFDEX AB, Landskrona (SE)

( * ) Notice: Subject to any disclaimer, the term of this patent is extended or adjusted under 35 U.S.C. 154(b) by 644 days.

(21) Appl. No.: 15/738,386

(22) PCT Filed: May 30, 2016

(86) PCT No.: PCT/EP2016/062158
§ 371 (c)(1),
(2) Date: Dec. 20, 2017

(87) PCT Pub. No.: WO2017/005406
PCT Pub. Date: Jan. 12, 2017

(65) Prior Publication Data

US 2018/0169668 A1 Jun. 21, 2018

(30) Foreign Application Priority Data

Jul. 3, 2015 (EP) ..... 15175244

(51) Int. Cl.
*B04B 5/00* (2006.01)
*B04B 9/04* (2006.01)
(Continued)

(52) U.S. Cl.
CPC ..... *B04B 5/12* (2013.01); *B04B 5/005* (2013.01); *B04B 5/08* (2013.01); *B04B 9/04* (2013.01);
(Continued)

(58) Field of Classification Search
CPC .. B04B 5/12; B04B 5/08; B04B 5/005; B04B 9/04; B04B 2005/125; F01M 13/04; F01M 2013/0494; F01M 2013/0422
(Continued)

(56) References Cited

U.S. PATENT DOCUMENTS 1,950,586 A 3/1934 Zubaty
5,954,035 A * 9/1999 Hofer ..... F01M 13/04 123/573
(Continued)

FOREIGN PATENT DOCUMENTS

CN 1098336 A 2/1995
CN 1961139 A 5/2007
(Continued)

OTHER PUBLICATIONS

English translation of the Russian Decision to Grant for Russian Application No. 2018104076, dated Sep. 14, 2018.
(Continued)

*Primary Examiner* — Walter D. Griffin
*Assistant Examiner* — Shuyi S. Liu
(74) *Attorney, Agent, or Firm* — Birch, Stewart, Kolasch & Birch, LLP

(57) ABSTRACT

A centrifugal separator structure is configured for cleaning of crankcase gases from an internal combustion engine. The centrifugal separator structure includes a separator rotor configured for rotation about a centre axis arranged inside a stationary housing. The separator rotor includes an axle member configured for connection to a shaft of a driving device. A stack of separation discs is supported on the axle member. The axle member is un-journaled inside the stationary housing when the centrifugal separator structure is
(Continued)

separate from the driving device. Further, an assembly includes the centrifugal separator structure and a driving device.

20 Claims, 4 Drawing Sheets

(51) Int. Cl.
*B04B 5/08* (2006.01)
*B04B 5/12* (2006.01)
*F01M 13/04* (2006.01)

(52) U.S. Cl.
CPC ..... *F01M 13/04* (2013.01); *B04B 2005/125* (2013.01); *F01M 2013/0422* (2013.01); *F01M 2013/0494* (2013.01)

(58) Field of Classification Search
USPC ..... 494/24, 43, 46, 49, 60, 62, 82, 84
See application file for complete search history.

(56) References Cited

U.S. PATENT DOCUMENTS

| | | | | |
|---|---|---|---|---|
| 6,520,902 | B1 * | 2/2003 | Brown et al. | B04B 1/06 494/24 |
| 7,152,589 | B2 | 12/2006 | Ekeroth et al. | |
| 7,396,373 | B2 | 7/2008 | Lagerstedt et al. | |
| 9,074,558 | B2 | 7/2015 | Roelver | |
| 9,714,591 | B2 | 7/2017 | Szepessy | |
| 9,821,322 | B2 | 11/2017 | Hornung | |
| 2004/0168415 | A1 * | 9/2004 | Hilpert et al. | F02M 25/06 55/406 |
| 2008/0041330 | A1 * | 2/2008 | Ullein | F16F 15/264 123/192.2 |
| 2008/0264251 | A1 | 10/2008 | Szepessy | |
| 2009/0241920 | A1 | 10/2009 | Inge et al. | |
| 2009/0266231 | A1 | 10/2009 | Franzen et al. | |
| 2013/0067873 | A1 | 3/2013 | Szepessy et al. | |
| 2013/0095993 | A1 * | 4/2013 | Isaksson et al. | B04B 7/08 494/43 |
| 2014/0230381 | A1 | 8/2014 | Törnblom | |
| 2015/0119226 | A1 | 4/2015 | Pogén | |
| 2017/0120176 | A1 * | 4/2017 | Ishida et al. | B04B 7/14 |

FOREIGN PATENT DOCUMENTS

| | | | | |
|---|---|---|---|---|
| CN | 202803428 | U | 3/2013 | |
| CN | 103097033 | A | 5/2013 | |
| CN | 103702737 | A | 4/2014 | |
| CN | 103874832 | A | 6/2014 | |
| CN | 104303279 | A | 1/2015 | |
| DE | 43 14 440 | C1 | 6/1994 | |
| EP | 0 933 507 | A1 | 8/1999 | |
| EP | 1424 133 | A2 | 5/2004 | |
| GB | 2 277 700 | A | 11/1994 | |
| GB | 2277700 | A * | 11/1994 | B04B 9/04 |
| JP | 2009-520154 | A | 5/2009 | |
| JP | 2013-523435 | A | 6/2013 | |
| JP | 2013-527363 | A | 6/2013 | |
| JP | 2014-530989 | A | 11/2014 | |
| RU | 2315872 | C2 | 1/2008 | |
| SE | 519 180 | C2 | 1/2003 | |
| WO | WO 02/20120 | A1 | 3/2002 | |
| WO | WO 2004/001200 | A1 | 12/2003 | |
| WO | WO 2004/001201 | A1 | 12/2003 | |

OTHER PUBLICATIONS

International Search Report, issued in PCT/EP2016/062158, dated Aug. 4, 2016.
Written Opinion of the International Searching Authority, issued in PCT/EP2016/062158, dated Aug. 4, 2016.
Chinese Office Action and Search Report, dated Apr. 23, 2019, for Chinese Application No. 201680039229.3.
Japanese Office Action dated Feb. 25, 2019, for corresponding Japanese Application No. 2017-567713, with English translation.
European Office Aciton dated Oct. 22, 2020 for Application No. 15 175 244.1.

* cited by examiner

CENTRIFUGAL SEPARATOR STRUCTURE AND ASSEMBLY HAVING AN UNJOURNALED AXLE MEMBER

TECHNICAL FIELD

The present invention relates to a centrifugal separator structure for cleaning of crankcase gases emanating from an internal combustion engine, as well as to an assembly comprising a centrifugal separator structure for cleaning of crankcase gases emanating from an internal combustion engine.

BACKGROUND

Crankcase gases from an internal combustion engine are ventilated from a crankcase of a relevant combustion engine. Crankcase gases may be disposed of in an environmentally friendly manner instead of being ventilated in untreated form to the atmosphere. For certain types of combustion engines, legislation requires crankcase gases to be disposed of in an environmentally friendly manner.

Crankcase gases may comprise inter alia blow-by gases, oil, other liquid hydrocarbons, soot, and other solid combustion residues. In order to dispose of crankcase gases suitably, the gas is separated from oil, soot, and other residues. The separated gas may be led to an air intake of the combustion engine or vented to the atmosphere, and the oil may be led back to an oil sump of the combustion engine optionally, via an oil filter for removing soot and other solid residues from the oil.

A centrifugal separator may be used for disposing of crankcase gases. Separation discs in the form of truncated conical discs, of the centrifugal separator, are arranged in a disc stack with small interspaces between the separation discs. The crankcase gases are led into the rotating disc stack and heavy constituents of the crankcase gases, such as oil and soot, are forced against inner surfaces of the separation discs and form droplets as they travel along the separation discs towards an outer periphery of the disc stack. The droplets are thrown onto an inner wall of a housing of the centrifugal separator and are led out of the centrifugal separator via an oil outlet. The cleaned crankcase gases are led out of the centrifugal separator via a gas outlet.

SE 519180 discloses a centrifugal filter for removing oil and particles from crankcase gases in an internal combustion engine with closed crankcase ventilation. The centrifugal filter comprises a number of truncated conical discs arranged on a rotor axle of the centrifugal filter. The rotor axle is supported in a bearing in a housing of the centrifugal filter. A pulley is arranged on the rotor axle. The crankshaft of the internal combustion engine drives a number of auxiliary devices via a belt circuit, including the centrifugal filter.

WO 2004/001201 discloses a gas cleaning separator. For cleaning of crankcase gas produced by an internal combustion engine use is made of a centrifugal rotor, which is journaled in a housing by two axially separated bearings. A rotor body of the centrifugal rotor comprises a large number of conical separation discs. The centrifugal rotor is rotated by an electrical motor integrally arranged with the centrifugal rotor. The electrical motor has a stator, which is kept non-rotating and is charged with electric current for rotation of the centrifugal rotor.

An engine compartment of a modern vehicle is packed with a multitude of different components. Thus, space is limited and there is a general desire in the vehicle industry to provide more space in an engine compartment.

SUMMARY

It is an object of the present invention to reduce the volume occupied by a centrifugal separator for cleaning of crankcase gases emanating from an internal combustion engine.

According to an aspect of the invention, the object is achieved by a centrifugal separator structure configured for cleaning of crankcase gases from an internal combustion engine. The centrifugal separator structure comprises a stationary housing and a separator rotor configured for rotation about a centre axis arranged inside the stationary housing. The stationary housing comprises an inlet for crankcase gases, a gas outlet, and a liquid outlet. The separator rotor comprises a stack of separation discs, each separation disc of the stack of separation discs having a truncated conical shape. The separator rotor comprises an axle member. The axle member is configured for connection to a shaft of a driving device for the centrifugal separator structure. The stack of separation discs is supported on the axle member.

Since the separator rotor comprises an axle member, the stack of separation discs being supported on the axle member, and which axle member is configured for connection to a shaft of a driving device for the centrifugal separator structure, the centrifugal separator structure is provided for connection to any separate driving device having an available rotatable shaft. The separator rotor thus, is driven together with the driving device.

Accordingly, the centrifugal separator structure together with the driving device forms a unit which is operable as a centrifugal separator for cleaning of crankcase gases. Thus, the space that would be required for a separate drive means for a centrifugal separator having its own driving means is saved. As a result, the above mentioned object is achieved.

The centrifugal separator structure is a separate unit configured for attachment to the driving device. The stationary housing is stationary in relation to the separator rotor during use of the centrifugal separator structure for cleaning of crankcase gases. Herein the term cleaning of crankcase gases relates to separation of liquid and solid residues from gaseous blow-by gases of a crankcase of an internal combustion engine.

According to embodiments, the axle member may be un-journaled inside the stationary housing when the centrifugal separator structure is separate from the driving device. Accordingly, the axle member may not be journaled in the stationary housing of the centrifugal separator. Instead, the axle member and the separator rotor may be journaled via bearings of the driving device. Put differently, the axle member and the separator rotor cannot rotate freely inside the stationary housing unless the centrifugal separator structure is connected to the driving device. The centrifugal separator may thus be free of bearings that journal the axle member and separator rotor.

However, it is to be understood that the axle member and the rotor also may be journaled, e.g. by means of bearings, within the centrifugal separator.

According to embodiments, the axle member may comprise a sleeve configured for receiving the shaft of the driving device. In this manner the axle member may easily be centred on the shaft of the driving device. The axle member may further configured to form a spline connection with a shaft of a driving device. Thus, the axle member may comprise a solid shaft with a spline connection. The axle member may further be configured to form a threaded connection with a shaft of a driving device. Thus, the axle member may comprise a solid shaft with a threaded connection.

According to a further aspect of the invention, the above mentioned object is achieved by an assembly comprising a centrifugal separator structure according to any one of aspects and/or embodiments disclosed herein and a driving device connected to the centrifugal separator structure. The axle member of the centrifugal separator structure is connected to a shaft of the driving device. The axle member is supported by the shaft of the driving device such that the separator rotor is rotatable within the stationary housing about the centre axis by the driving device.

Since the axle member of the centrifugal separator structure is connected to the shaft of the driving device, and since the axle member is supported by the shaft of the driving device, the separator rotor is driven together with the driving device. Thus, the space that would be required by a separate drive means for the centrifugal separator is saved. As a result, the above mentioned object is achieved.

The driving device may be configured for rotating the separator rotor of the centrifugal separator structure and at least one unit other than the centrifugal separator. The shaft of driving device may thus be configured for transmitting torque to the separator rotor of the centrifugal separator structure and to at least one unit other than the centrifugal rotor. Thus, the driving device may be used for rotating both the centrifugal separator and another unit. In other words, a shaft that is arranged to be rotated by the driving device in another unit, i.e. in a unit different from the centrifugal separator, is also connected to the axle member so that the same shaft is used to rotate the centrifuge rotor and another unit. The driving device may for example be an electric current generator, a water pump, a wheel of a belt circuit of a combustion engine or an engine.

In the assembly the two separate units formed by each of the centrifugal separator structure and the driving device are connected to form one single unit.

According to embodiments, the driving device may be an electric current generator of an internal combustion engine, the electric current generator comprising a stator and a generator rotor configured for rotation inside the stator. The generator rotor may comprise the shaft of the driving device forming a rotor axle of the generator rotor. The rotor axle may extend along the centre axis.

However, the shaft may also be a shaft of other driving devices, such as a shaft of a water pump, an axle to the wheel of a belt circuit of a combustion engine or a cam shaft. The shaft may be driven by e.g. a belt drive or a direct drive using an electric motor.

As a further aspect of the invention, there is provided a method for cleaning a gas containing contaminants comprising the steps of providing an assembly according to the aspect above, introducing gas containing contaminants into inlet of the centrifugal separator, and discharging cleaned gas through the gas outlet of the centrifugal separator and discharging contaminants separated from the gas through the liquid outlet of the centrifugal separator.

The step of providing a centrifugal separator also comprises rotating the separator rotor of the centrifugal separator.

In embodiments, gas containing contaminants is crankcase gas of a combustion engine and said contaminants comprise oil.

Further features of, and advantages with, the present invention will become apparent when studying the appended claims and the following detailed description.

BRIEF DESCRIPTION OF THE DRAWINGS

Various aspects of the invention, including its particular features and advantages, will be readily understood from the example embodiments discussed in the following detailed description and the accompanying drawings, in which.

DETAILED DESCRIPTION

Aspects of the present invention will now be described more fully. Like numbers refer to like elements throughout. Well-known functions or constructions will not necessarily be described in detail for brevity and/or clarity.

Figure 1:
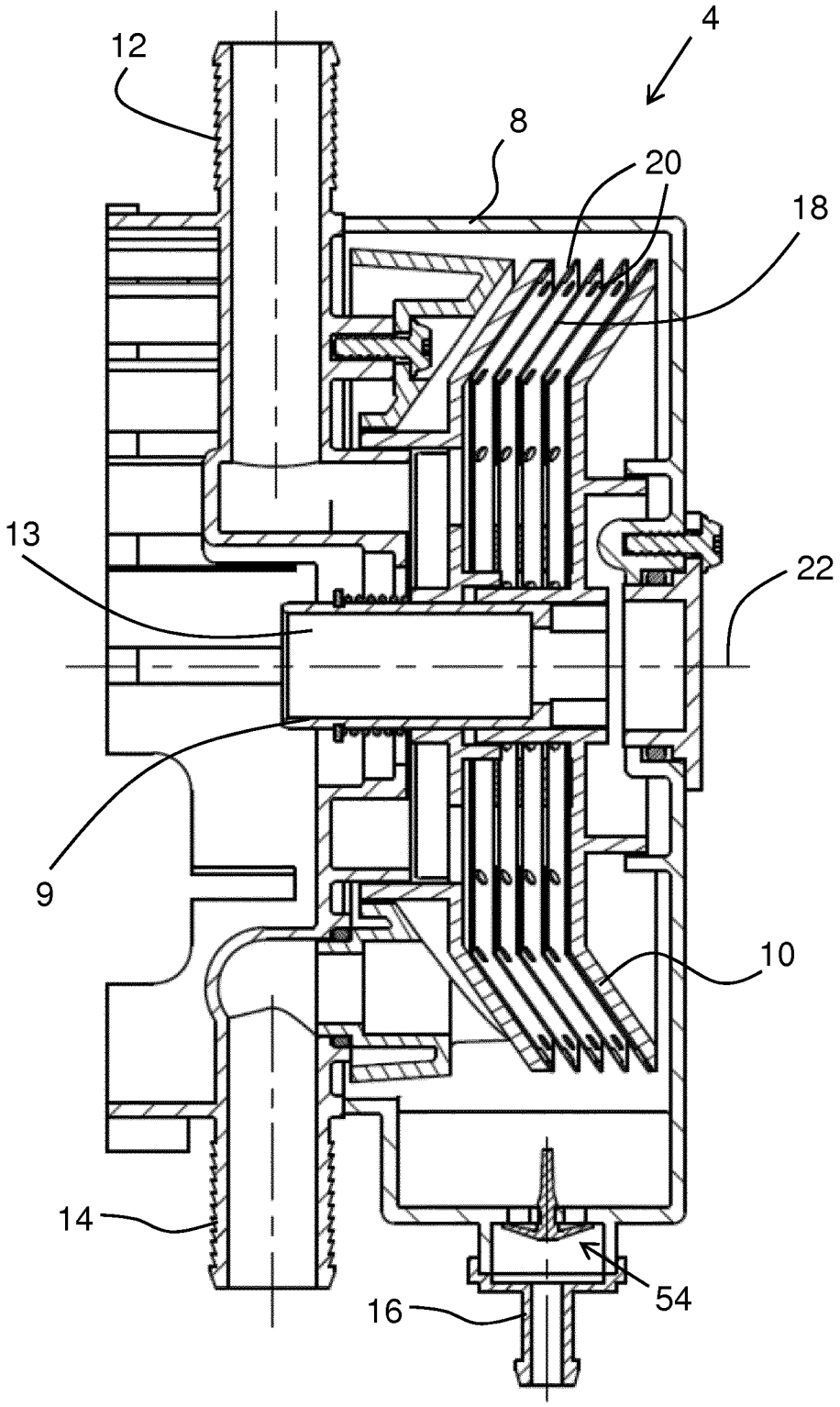
FIG. 1 illustrates embodiments of a centrifugal separator structure.

FIG. 1 illustrates embodiments of a centrifugal separator structure 4. The centrifugal separator structure 4 is configured for cleaning of crankcase gases from an internal combustion engine. The centrifugal separator structure 4 comprises a stationary housing 8 and a separator rotor 10 configured for rotation about a centre axis 22. The separator rotor 10 is arranged inside the stationary housing 8. The stationary housing comprises an inlet 12 for crankcase gases, a gas outlet 14, and a liquid outlet 16. The separator rotor 10 comprises a stack 18 of separation discs 20. Each separation disc 20 of the stack 18 of separation discs 20 has a truncated conical shape.

The separator rotor 10 comprises an axle member 9. The axle member 9 is configured for connection to a shaft of a driving device for the centrifugal separator structure 4. The axle member 9 comprises a sleeve 13 configured for receiving the shaft of the driving device. The stack 18 of separation discs 20 is supported on the axle member 9. The centre axis 22 extends centrally through the separation discs 20 and in this embodiment through the axle member 9.

The centrifugal separator structure 4 is a separate unit configured for connection to a relevant driving device. Thus, when the centrifugal separator structure 4 is connected to the driving device, and the axle member 9 is connected to a shaft of the driving device, the centre axis 22 is aligned with the shaft of the driving device, see FIG. 2.

The axle member 9 is un-journaled inside the stationary housing 8 when the centrifugal separator structure 4 is separate from the driving device. The axle member 9 is not journaled in the stationary housing 8 of the centrifugal separator structure 4. When the centrifugal separator structure 4 is not connected to a driving device, the separator rotor 10 may rest against one or more inner surfaces of the stationary housing 8. The axle member may thus be unsupported inside the stationary housing except for any inner surface against which the axle member and rotor may rest. It is only when the axle member 9 is connected to the shaft of the driving device that the axle member 9 may be journaled. Namely, journaled via bearings of the driving device. Accordingly, the separator rotor 10 cannot rotate freely inside the stationary housing 8 unless the centrifugal separator structure 4 is connected to the driving device, see further below with reference to FIG. 2.

The inlet 12 for crankcase gases is configured to be in a permanent open connection with an internal space of a crankcase of the internal combustion engine. Thus, the centrifugal separator structure 4 is continuously available for cleaning of crankcase gases.

The inlet 12 for crankcase gases may be configured to direct crankcase gases towards a central portion of the stack 18 of separation discs 20. In this manner the flow of the crankcase gases through the centrifugal separator structure 4 may be controlled.

The liquid outlet 16 may be arranged at a peripheral outer portion of the stationary housing 8. A check valve 54 may be associated with the liquid outlet 16. In this manner inflow via the liquid outlet 16 may be prevented while separated liquid, such as oil containing residues, may flow out thorough the liquid outlet 16.

Figure 2:
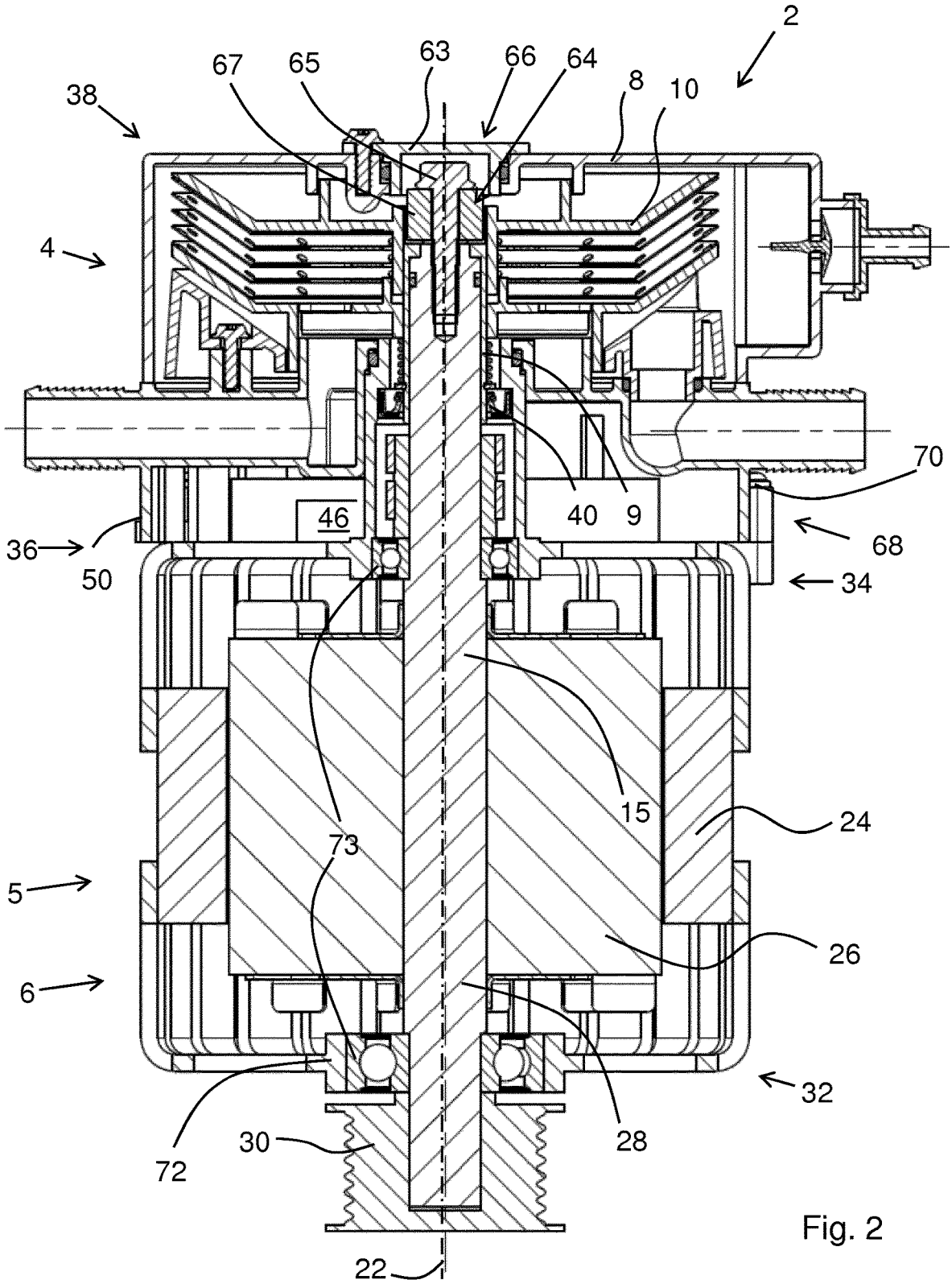
FIG. 2 illustrates a cross section through an assembly according to embodiments.

FIG. 2 illustrates a cross section through an assembly 2 according to embodiments. The assembly 2 comprises a centrifugal separator structure 4 and a driving device 5. The driving device 5 is connected to the centrifugal separator structure 4. The centrifugal separator structure 4 may be a centrifugal separator structure according to any one of aspects and/or embodiments disclosed herein, such as e.g. the centrifugal separator structure 4 of the FIG. 1, which also is referred to in the following. The axle member 9 of the centrifugal separator structure 4 is connected to a shaft 15 of the driving device 5. The axle member 9 is supported by the shaft 15. Thus, the axle member 9 and the separator rotor 10 are rotatable about the centre axis 22 by the driving device 5, within the stationary housing 8 of the centrifugal separator structure 4.

In this embodiment, the centrifugal separator structure 4 comprises a securing member 64 configured for securing the axle member 9 to the shaft 15 of the driving device 5. Thus, a distal end portion of the axle member 9 may be secured to the shaft 15 on a side of the stack 18 of separation discs 20 opposite the driving device 5. In these embodiments the securing member 64 comprises a bolt 65 secured in a threaded hole in the shaft 15. The securing member 64 may comprise an engagement member 67, such as a rubber bushing which expands when the bolt 65 is tightened. Alternatively, or additionally, the securing member may comprise splines, or a key for rotationally interlocking the axle member 9 with the shaft 15. Other kinds of suitable securing members are also foreseen.

The stationary housing 8 comprises an access opening 66 for fitting and/or accessing the securing member 64 inside the stationary housing 8. In this manner access for fastening or removing the securing member 64 may be provided. A cover 63 may be provided for closing the access opening 66.

The driving device 5 comprises a casing 72 in which the shaft 15 of the driving device 5 is journaled. In these embodiments the shaft 15 is journaled in two ball bearings 73 arranged in the casing 72. However, the shaft 15 may also be journaled to other parts than the casing of the driving device.

The stationary housing 8 comprises at least one connection member 68 for connecting the stationary housing 8 to the driving device 5. Thus, also the stationary housing 8 may be secured to the driving device 5. In these embodiments, the connection member 68 comprises a screw 70, by means of which the stationary housing 8 is fixed to the casing 72 of the driving device 5. Other kinds of suitable connecting members are also foreseen.

The driving device 5 comprises a drive wheel 30 connected to the shaft 15 of the driving device 5 at a first end portion 32 of the driving device 5. The drive wheel 30 is configured to be driven by an internal combustion engine. In this manner the centrifugal separator structure 4 may be driven by the internal combustion engine via the drive wheel 30 and the shaft 15.

The centrifugal separator structure 4 is arranged at a second end portion 34 of the driving device, opposite to the first end portion 32.

The stationary housing 8 comprises a proximal end portion 36 and a distal end portion 38. The proximal end portion 36 faces the second end portion 34 of the driving device 5. The axle member extends from the proximal end portion 36 of the stationary housing 8 adjacent to the driving device 5 to a distal end portion 38 of the stationary housing. The distal end portion of the axle member is configured for connection to the shaft 15 of the driving device.

The shaft 15 of the driving device 5 extends through the second end portion 34 and through the proximal end portion 36. A radial sealing 40 is provided around the axle member 9 for sealing off an inside of the stationary housing 8 towards the driving device 5. In this manner the driving device 5 may not be contaminated by the crankcase gases in the stationary housing 8 of the centrifugal separator structure.

In these embodiments the driving device 5 is an electric current generator 6 of an internal combustion engine. The electric current generator 6 comprises a stator 24 and a generator rotor 26 configured for rotation inside the stator 24. The generator rotor 26 comprises the shaft 15 of the driving device 5 forming a rotor axle. The rotor axle, i.e. the shaft 15 extends along the centre axis 22. Since the electric current generator 6 is always rotated when the internal combustion engine is running, the centrifugal separator 4 will also be running and thus, be available for the cleaning of the crankcase gases.

The electric current generator 6 comprises an electrical connector 46 arranged at the second end portion 34. In this manner the electric current generator may be connected to e.g. a battery of a relevant vehicle. Moreover, due to the electrical connector being arranged at the second end portion, the assembly does have limited radial extension.

The assembly 2 comprises a distance element 50 arranged between the stationary housing 8 and the second end portion 34. The distance element 50 at least partially encloses the electrical connector 46. Thus, the distance element 50 provides a space between the stationary housing 8 and the second end portion 34, in which space the electrical connector 46 is protected. In these embodiments the distance element 50 is connected to the stationary housing 8.

Figure 3:
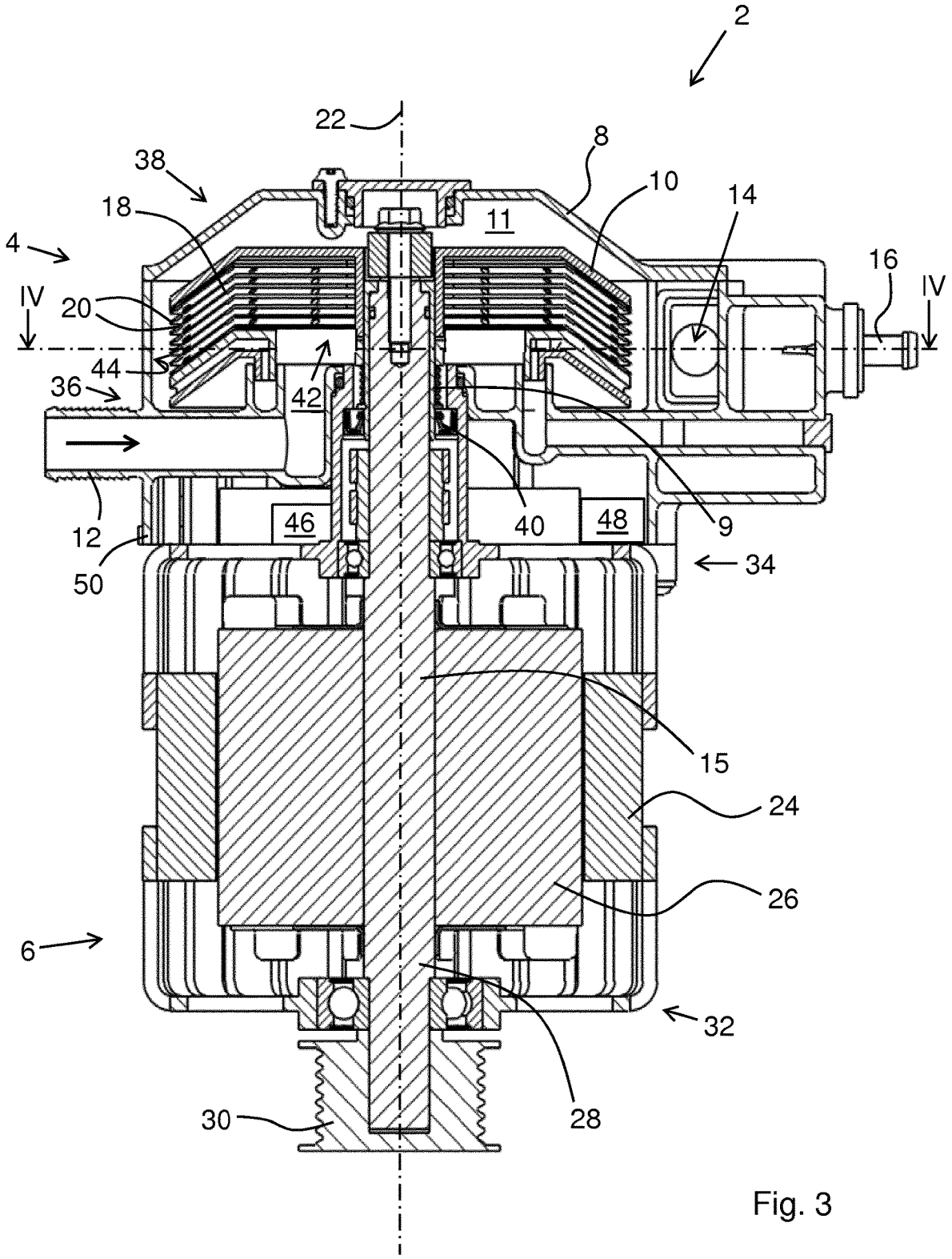
FIG. 3 illustrates embodiments of an assembly comprising a centrifugal separator structure and an electric current generator.

FIG. 3 illustrates embodiments of an assembly 2 comprising a centrifugal separator structure 4 and a driving device in the form of an electric current generator 6. The centrifugal separator structure 4 is configured for cleaning of crankcase gases emanating from an internal combustion engine. The centrifugal separator structure 4 comprises a stationary housing 8 and a separator rotor 10 rotatably arranged inside a chamber 11 formed in the stationary housing 8. The stationary housing 8 comprises an inlet 12 for crankcase gases, a gas outlet 14, and a liquid outlet 16. The separator rotor 10 comprises a stack 18 of separation discs 20. Each separation disc 20 of the stack 18 of separation discs 20 has a truncated conical shape. A centre axis 22 extends through the assembly 2.

The electric current generator 6 is configured for use as an electric current generator connected to an internal combustion engine. The electric current generator 6 comprises a stator 24 and a generator rotor 26 configured for rotation inside the stator 24. The generator rotor 26 comprises a rotor axle 28. The rotor axle 28 extends along the centre axis 22. The rotor axle 28 is connected to the separator rotor 10. Again, the separator rotor 10 comprises an axle member 9 and a shaft 15 that forms the rotor axle 28.

The electric current generator 6 comprise a drive wheel 30 connected to the rotor axle 28. The drive wheel 30 is configured to be driven by the internal combustion engine. In these embodiments the drive wheel 30 comprises a pulley for a belt drive. In alternative embodiments, the drive wheel may for instance comprise a cog wheel.

The drive wheel 30 is arranged at a first end portion 32 of the electric current generator 6. The centrifugal separator structure 4 is arranged at a second end portion 34 of the electric current generator 6. The second end portion 34 is positioned opposite to the first end portion 32. The first and second end portions 32, 34 form axial end portions of the electric current generator 6, i.e. they form end portions along the centre axis 22.

The stationary housing 8 of the centrifugal separator structure 4 comprises a proximal end portion 36 and a distal end portion 38. The proximal end portion 36 faces the second end portion 34 of the electric current generator 6. The rotor axle 28 extends through the second end portion 34 of the electric current generator 6. The rotor axle 28 further extends through the proximal end portion 36 of the stationary housing 8. A radial sealing 40 is provided around the axle member 9 for sealing off an inside of the stationary housing 8 towards the electric current generator 6. The sealing 40 may comprise e.g. a simmering seal. Thus, crankcase gases, oil and soot will be prevented from leaking along the axle member 9 from the chamber 11 in the housing 8 of the centrifugal separator structure 4 into the electric current generator 6.

The inlet 12 for crankcase gases is configured to be in a permanent open connection with an internal space of a crankcase of the internal combustion engine. Thus, the centrifugal separator structure 4 is continuously available for cleaning of crankcase gases. Since the electric current generator 6 is always rotated when the internal combustion engine is running, the centrifugal separator structure 4 will also be running and thus, be available for the cleaning of the crankcase gases.

In these embodiments, the inlet 12 for crankcase gases is arranged at the proximal end portion 36. The inlet may alternatively be arranged at other portions of the centrifugal separator structure 4. Further, the inlet 12 is configured to direct crankcase gases towards a central portion 42 of the stack 18 of separation discs 20. Thus, an open connection is formed by the inlet 12 into the stack 18 of separation discs 20.

During operation of the assembly 2, the crankcase gases from the inlet 12 are distributed through the stack 18 via openings in the central portions of the separation discs 20. As the separator rotor 10 rotates, the crankcase gases are transported radially outwardly in the interspaces between the separation discs 20. Heavy constituents of the crankcase gases, such as oil and soot, are forced against inner surfaces of the separation discs 20 and form droplets as they travel along the separation discs 20 towards an outer periphery of the separator rotor 10. The droplets are thrown onto an inner wall 44 of the chamber 11 of the stationary housing 8 and are lead out of the centrifugal separator structure 4 via the liquid outlet 16. The cleaned crankcase gases are lead out of the centrifugal separator structure 4 via the gas outlet 14.

The gas outlet 14 is arranged at a central portion of the stationary housing 8, but may alternatively be arranged at the distal end portion 38, or at the proximal end portion 36, as in the embodiments of FIGS. 1 and 2.

The electric current generator 6 comprises an electrical connector 46 arranged at the second end portion 34. The electrical connector 46 may form part of a connection to e.g. a battery of a relevant vehicle. Further electrical components may form part of the connection to the battery, such as e.g. one or more diodes. Also arranged at the second end portion 34 may be further electrical elements and/or modules, such as e.g. a voltage regulator 48.

The assembly 2 comprises a distance element 50 arranged between the stationary housing 8 and the second end portion 34 of the electrical generator 6. The distance element 50 at least partially encloses the electrical connector 46. The distance element 50 may form a wall portion. The distance element 50 may be provided with openings, e.g. in the form of slits, for providing ventilation of the voltage regulator 48.

Figure 4:
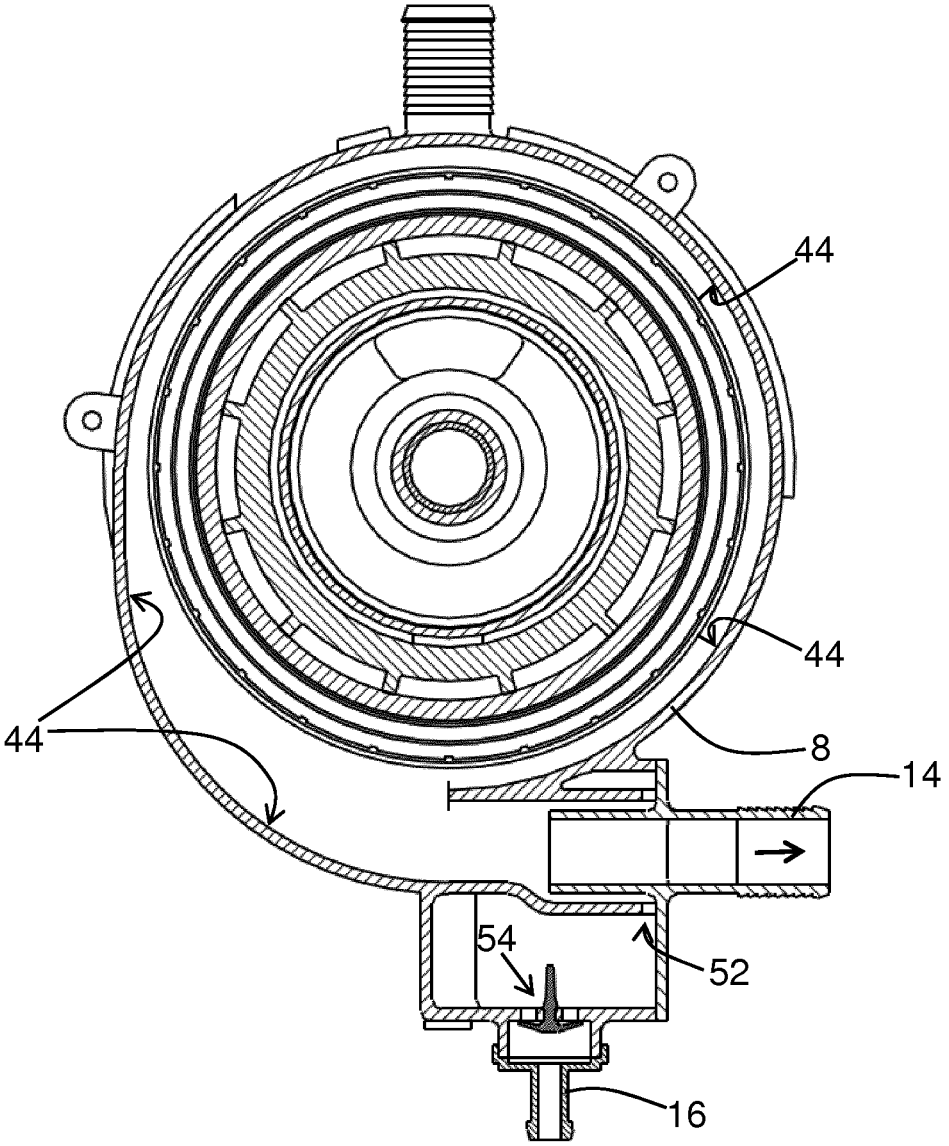
FIG. 4 illustrates a cross section along line IV-IV of FIG. 3.

FIG. 4 illustrates a cross section along line IV-IV of FIG. 3 through the centrifugal separator structure 4 of the assembly 2. The cross section extends through inter alia the gas outlet 14. The inner wall 44 of the chamber 11 is clearly shown in FIG. 3. Oil and soot separated from the crankcase gases flowing along the inner wall 44 reach the liquid outlet 16 via one or more openings 52 in the inner wall 44. The liquid outlet 16 is arranged at a peripheral outer portion of the stationary housing 8. More specifically, the liquid outlet 16 is arranged at a lower peripheral portion of the stationary housing 8. Thus, gravity will force the oil and soot towards the liquid outlet 16.

A check valve 54 is associated with the liquid outlet 16. That is, oil and soot may flow out of the stationary housing 8 via the check valve 54 and the liquid outlet 16, but inflow via the liquid outlet 16 is prevented by the check valve 54. For example, if the liquid outlet 16 is connected to the crankcase of a combustion engine, the inflow of crankcase gases into the centrifugal separator via the liquid outlet 16 is prevented by the check valve 54. When the pressure inside the stationary housing 8 of the centrifugal separator structure 4 is higher than the pressure in the crankcase of the combustion engine, the check valve 54 is open. If the pressure in the crankcase is higher than in the stationary housing 8, the check valve 54 is closed.

This invention should not be construed as limited to the embodiments set forth herein. A person skilled in the art will realize that different features of the embodiments disclosed herein may be combined to create embodiments other than those described herein, without departing from the scope of the present invention, as defined by the appended claims. Although the invention has been described with reference to example embodiments, many different alterations, modifications and the like will become apparent for those skilled in the art. Therefore, it is to be understood that the foregoing is illustrative of various example embodiments and that the invention is defined only by the appended claims.

As used herein, the term "comprising" or "comprises" is open-ended, and includes one or more stated features, elements, steps, components or functions but does not preclude the presence or addition of one or more other features, elements, steps, components, functions or groups thereof.

The invention claimed is:

1. A centrifugal separator structure configured for cleaning of crankcase gases from an internal combustion engine, the centrifugal separator structure comprising:

a stationary housing; and a separator rotor configured for rotation about a centre axis arranged inside the stationary housing, wherein the stationary housing comprises an inlet for crankcase gases, a gas outlet, and a liquid outlet, and wherein the separator rotor comprises a stack of separation discs, each separation disc of the stack of separation discs having a truncated conical shape, wherein the separator rotor comprises an axle member, wherein the stack of separation discs is supported on the axle member, wherein the axle member extends from a proximal end portion of the stationary housing adjacent to a driving device for the centrifugal separator structure to a distal end portion of the stationary housing, wherein a distal end portion of the axle member is configured for connection to a shaft of the driving device for the centrifugal separator structure, the distal end portion of the axle member being on a side of the stack of separation discs opposite to the driving device, and wherein the axle member is un-journaled inside the stationary housing when the centrifugal separator structure is separate from the driving device.

2. The centrifugal separator structure according to claim 1, wherein the axle member comprises a sleeve configured for receiving the shaft of the driving device.

3. The centrifugal separator structure according to claim 1, comprising a securing member at the distal end portion of the axle member configured for securing the axle member to the shaft of the driving device.

4. The centrifugal separator structure according to claim 3, wherein the stationary housing comprises an access opening for fitting and/or accessing the securing member inside the stationary housing.

5. The centrifugal separator structure according to claim 1, wherein the stationary housing comprises at least one connection member for connecting the stationary housing to the driving device.

6. An assembly comprising:

the centrifugal separator structure according to claim 1; and a driving device connected to the centrifugal separator structure, wherein the axle member of the centrifugal separator structure is connected to a shaft of the driving device, and wherein the axle member is supported by the shaft of the driving device such that the separator rotor is rotatable within the stationary housing about the centre axis by the driving device.

7. The assembly according to claim 6, wherein the driving device comprises a casing in which the shaft of the driving device is journaled.

8. The assembly according to claim 6, wherein the driving device comprises a drive wheel connected to the shaft of the driving device at a first end portion of the driving device, the drive wheel being configured to be driven by an internal combustion engine.

9. The assembly according to claim 8, wherein the centrifugal separator structure is arranged at a second end portion of the driving device, opposite to the first end portion.

10. The assembly according to claim 9, wherein the stationary housing comprises a proximal end portion and a distal end portion, and wherein the proximal end portion faces the second end portion of the driving device.

11. The assembly according to claim 9, wherein the shaft of the driving device extends through the second end portion and through the proximal end portion, and wherein a radial sealing is provided around the axle member for sealing off an inside of the stationary housing towards the driving device.

12. The assembly according to claim 6, wherein the driving device is an electric current generator of an internal combustion engine, the electric current generator comprising a stator and a generator rotor configured for rotation inside the stator, wherein the generator rotor comprises the shaft of the driving device forming a rotor axle of the generator rotor, and wherein the rotor axle extends along the centre axis.

13. The assembly according to claim 9, wherein the driving device is an electric current generator of an internal combustion engine, and wherein the electric current generator comprises an electrical connector arranged at the second end portion.

14. The assembly according to claim 13, comprising a distance element arranged between the stationary housing and the second end portion, wherein the distance element at least partially encloses the electrical connector.

15. The centrifugal separator structure according to claim 2, comprising a securing member configured for securing the axle member to the shaft of the driving device.

16. The centrifugal separator structure according to claim 2, wherein the stationary housing comprises at least one connection member for connecting the stationary housing to the driving device.

17. The centrifugal separator structure according to claim 3, wherein the stationary housing comprises at least one connection member for connecting the stationary housing to the driving device.

18. The centrifugal separator structure according to claim 4, wherein the stationary housing comprises at least one connection member for connecting the stationary housing to the driving device.

19. The centrifugal separator structure according to claim 1, comprising a fastener for securing the axle member to the shaft of the driving device.

20. The centrifugal separator structure according to claim 1, wherein the stationary housing comprises at least one fastener for connecting the stationary housing to the driving device.

* * * * *